US005622129A

United States Patent [19]

Sahl

[11] Patent Number: 5,622,129

[45] Date of Patent: Apr. 22, 1997

[54] PNEUMATIC TENSIONING ARM FOR AUTOMATED SEWING MACHINE

[75] Inventor: Johannes Sahl, Krems, Austria

[73] Assignee: Jet Sew Technologies, Inc., Bowling Green, Ky.

[21] Appl. No.: 546,266

[22] Filed: Oct. 20, 1995

[51] Int. Cl.[6] ..... D05B 27/10

[52] U.S. Cl. ..... 112/470.29; 112/305; 112/318

[58] Field of Search ..... 112/305, 306, 112/314, 322, 475.12, 470.31, 470.29, 63, 153

[56] References Cited

U.S. PATENT DOCUMENTS

| | | | |
|---|---|---|---|
| 3,865,058 | 2/1975 | Rovin et al. . | |
| 4,046,087 | 9/1977 | Manetti . | |
| 4,098,201 | 7/1978 | Adamski, Jr. et al. . | |
| 4,185,570 | 1/1980 | Kleinschmidt et al. . | |
| 4,473,017 | 9/1984 | Letard et al. | 112/470.31 X |
| 4,479,447 | 10/1984 | Rohr . | |
| 4,512,268 | 4/1985 | Rohr . | |
| 4,640,206 | 2/1987 | Nishikawa . | |
| 4,827,857 | 5/1989 | Fieschi et al. . | |
| 5,131,336 | 7/1992 | Kono et al. . | |
| 5,269,239 | 12/1993 | Adamski, Jr. et al. . | |
| 5,271,347 | 12/1993 | Carreras Fontcuberta . | |
| 5,437,238 | 8/1995 | Price et al. | 112/153 X |
| 5,522,332 | 6/1996 | Price et al. | 112/470.31 X |

FOREIGN PATENT DOCUMENTS 2730291 1/1979 Germany .

*Primary Examiner*—Ismael Izaguirre

[57] ABSTRACT

An automated circular sewing machine system for attaching an elastic band to a tubular body of fabric or simply forming and sewing a hem thereon. The system includes, among other things, a sewing head which is located between a pair of elongated work holding roller assemblies which project outwardly on either side of the sewing head. The roller assemblies include a front or feed side roller assembly and a rear or drive and tensioning roller assembly. The front roller assembly is free wheeling and is fixed in position relative to the sewing head. The drive and tensioning roller assembly includes a movable drive and tensioning roller driven by a motor and consisting of a solid unitary member which is generally cylindrical with a rounded outer nose portion and an inner fabric support surface. The entire drive and tensioning roller assembly is pre-positioned by a laterally movable clamping plate assembly to a fixed position relative to the sewing head depending on the size of the tubular body being sewn. The drive and tensioning roller is thereafter moved, i.e. rotated, away from a generally vertical "home" position a predetermined distance from the sewing head and front roller assembly by a pneumatically activated piston to tension to the member or members being sewn prior to and during a sewing operation. After the sewing operation is completed and prior to an unloading operation, the drive and tensioning roller is returned to its home position also under control of the pneumatic piston.

20 Claims, 5 Drawing Sheets

PNEUMATIC TENSIONING ARM FOR AUTOMATED SEWING MACHINE

CROSS REFERENCE TO RELATED APPLICATIONS

This application is related to the apparatus shown and described in U.S. Ser. No. 08/546,265 (BSKB 1553-157P) entitled "Fabric Tensioning System And Separator Plate For Automated Sewing Machine", filed in the name of Johannes Sahl on Oct. 20, 1995 and which is assigned to the assignee of this invention.

This application is also related to the apparatus shown and described in U.S. Ser. No. 08/371,032, entitled "Apparatus For Feeding A Workpiece In A Machine Tool" filed in the name of Johannes Sahl on Jan. 10, 1995, and now U.S. Pat. No. 5,568,778.

BACKGROUND OF THE INVENTION

1. Field of the Invention

This invention relates to automated sewing machines and more particularly to apparatus used in conjunction with circular sewing machines for tensioning a tubular piece of fabric prior to and during a sewing operation.

2. Description of the Prior Art

Automated sewing machines for eliminating or at least reducing the manual labor associated with the manufacture of textile articles are well known. One type of known automated sewing machine comprises a circular sewing machine for forming and sewing hems on the raw edges of a piece of fabric such as a tubular body. In addition, known are machines for sewing an elastic band on a tubular body of cloth fabric which is also at least slightly elastic, i.e. can be stretched to a certain degree, when placed under tension. Also included in such apparatus are means for tensioning the various components as well as means for folding material prior to the sewing of a hem thereon. Also known are means for detecting the position of fabric relative to a sewing head and the seams formed thereat including the leading edge thereof. While such apparatus presumably operates as intended, improvements in this type of apparatus continue to be made.

SUMMARY

Accordingly, it is an object of the present invention to provide an improvement in automated circular sewing machines.

It is a further object of the invention to provide an improvement in apparatus for feeding and guiding a tubular body of fabric past a circular sewing machine sewing head.

It is still a further object of the invention to provide an improvement in fabric tensioning apparatus in an automated circular sewing machine.

It is another object of the invention to provide apparatus for pneumatically tensioning a tubular workpiece prior to and during a sewing operation.

Briefly, the foregoing and other objects are achieved by means of an automated circular sewing machine system for attaching an elastic band to a tubular body of fabric or simply forming and sewing a hem thereon. The system is comprised of, among other things, a sewing head which is located between a pair of elongated work holding roller assemblies which project outwardly on either side of the sewing head. The roller assemblies include a front or feed side roller assembly and a rear or drive and tensioning roller assembly. The front roller assembly is free wheeling and is fixed in position relative to the sewing head. Where an elastic band is to be attached to a tubular body of fabric, the front roller assembly is comprised of a split roller assembly consisting of a pair of mutually aligned and free wheeling roller sections with the outer section being preferably tapered while the inner section resembles a flanged spool having a width sized for receiving and holding the elastic band in place thereon.

The rear roller assembly, on the other hand, includes a motor driven drive and tensioning roller consisting of a solid unitary member which is generally cylindrical with a rounded outer nose portion but has an inner rear surface portion including an annular groove having a width which is adapted to receive and hold the other half of the elastic band. The entire assembly is pre-positioned by means of a laterally movable clamping plate assembly to a fixed position relative to the sewing head depending on the size of the tubular body being sewn. The drive and tensioning roller is thereafter moved away from a generally vertical "home" position a predetermined distance from the sewing head and front roller assembly by an activated pneumatic piston to tension both the elastic band and tubular body during a sewing operation to form a set of uniformly spaced elasticized pleats around the tubular body when relaxed. After the sewing operation is completed, the rear roller returns to its home position also under control of the pneumatic piston.

Where there is only a need for forming a hem on a tubular body of fabric, the split roller assembly is replaced by a single solid free wheeling roller having a rear flat surface region of predetermined width which provides a surface against which an edge detector mechanism can operate to position the fabric during a sewing operation.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 5:
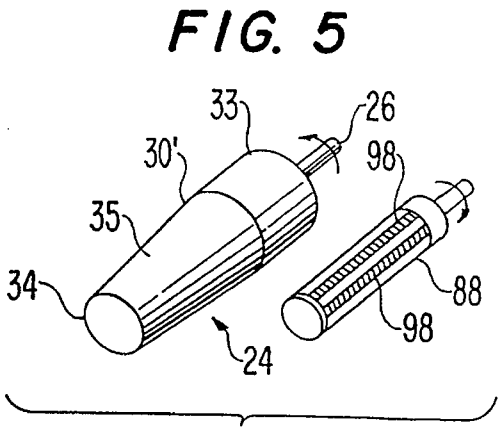
FIG. 5 is a partial perspective view of a modification of the embodiment shown in FIG. 1.
Figure 1:
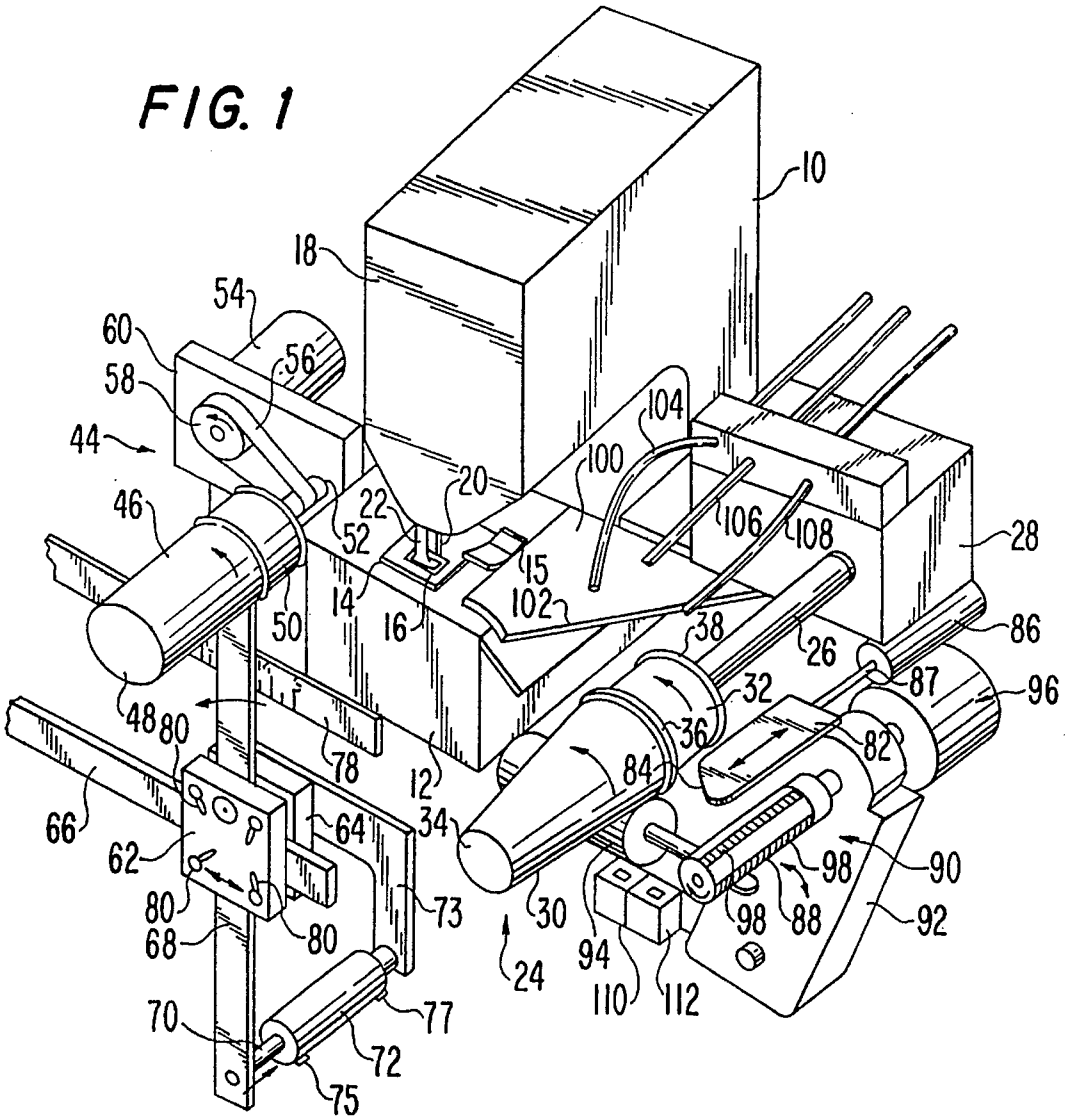
FIG. 1 is a perspective view of the preferred embodiment of the subject invention.

Referring now collectively to the drawings, and more particularly to FIGS. 1–4, the apparatus depicted thereat is an automated sewing machine controlled by a programmed microprocessor, not shown, for sewing an elastic band on a tubular piece of fabric. The fabric is also at least slightly elastic, i.e. can be stretched to a certain degree when placed under tension.

In the figures, reference numeral 10, for example, denotes a sewing head which includes, a housing 12 on which is located a needle plate 14 and a feed dog assembly 16. Depending from upper body portion 18 is at least one sewing needle 20 along with an associated presser foot 22.

On the right side of the sewing head 10 looking in toward the apparatus is a front or feed side roller assembly 24 which is fixed in position relative to the sewing head but is able to spin freely about a shaft 26 journaled in a support block 28. The front roller assembly 24 consists of two parts, an outer section 30 and an inner section 32. The outer section 30 comprises a tapered conical roller having a rounded nose portion 34 and comprises a free wheeling member relative to the inner section 32.

The inner section 32 comprises a flanged spool-like portion including a pair of relatively narrow or thin flanges 36 and 38 which are separated by a distance equal to the width of an elastic band 40 (FIG. 3) which is to be sewn on a tubular workpiece 42 (FIG. 4) and comprises a body of fabric, which may be, for example, a pair of athletic pants, commonly referred to as sweat pants, and which often include an elasticized waist portion.

Figure 3:
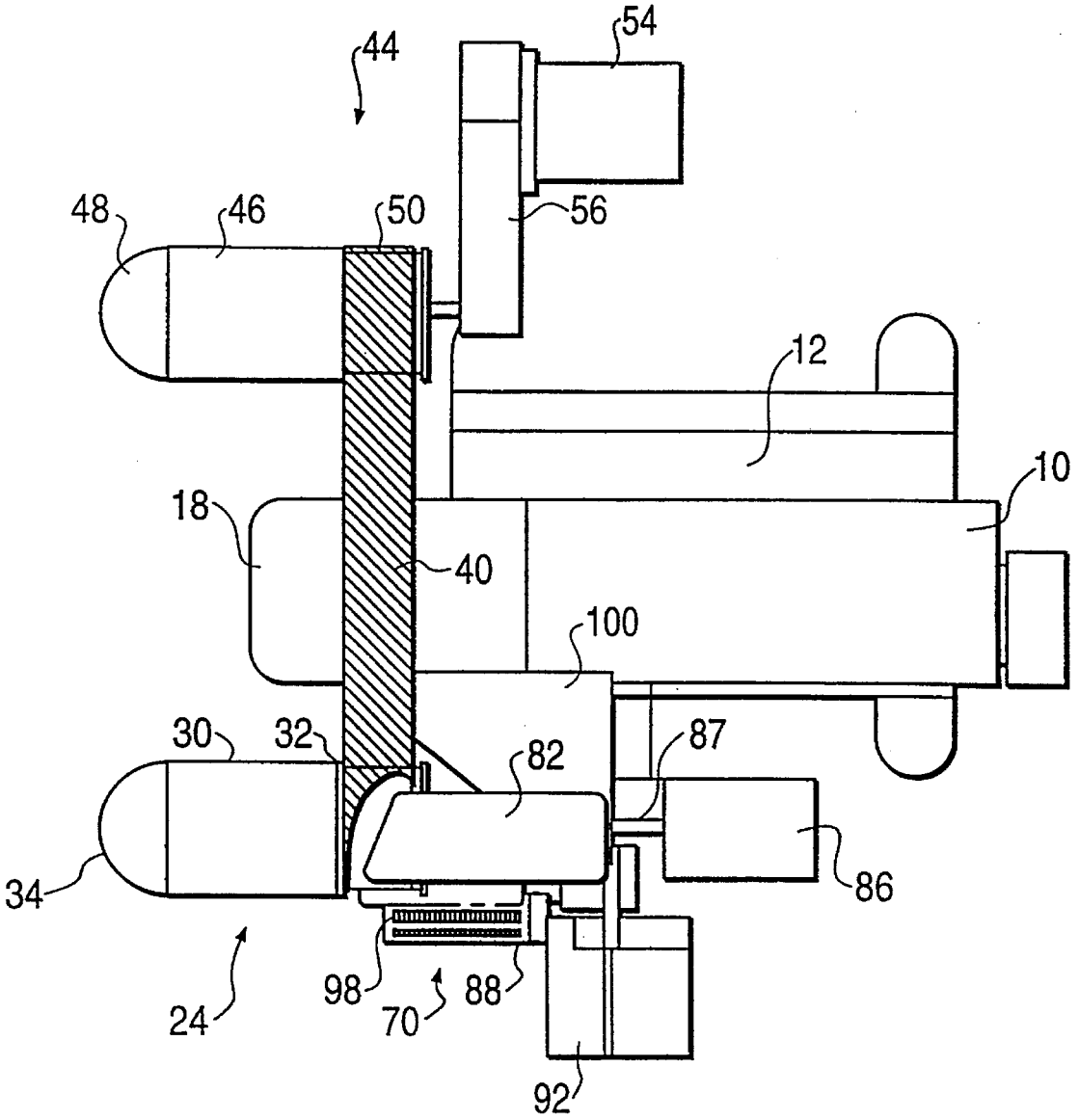
FIG. 3 is a top elevational view of the embodiment shown in FIG. 1, and additionally depicting an elastic band stretched between the rollers thereof.

On the left side of the sewing head 10 is located a rear drive and tensioning roller assembly 44 which includes, among other things, a generally cylindrical one piece drive and tensioning roller 46 having a rounded outer nose portion 48 and an annular groove 50 formed on a rear inner end portion thereof. The groove 50 is formed so as to have a width equal to the width of the elastic band 40 and is aligned with the flanged inner section 32 of the front roller assembly 30 so that an elastic band member 40 can be stretched and placed over the front and rear roller assemblies to engage and be retained by the flanged inner section 32 and the groove 50 as shown in FIG. 3, so as to extend under the needle 20 and presser foot 16 of the sewing head 10. Further as shown, the rear drive and tensioning roller 46 includes a shaft 52 which is driven by an electrical motor 54, preferably but not limited to a stepper motor, coupled to a drive belt 56 via a pulley 58 mounted on a support plate 60 which is also adapted to receive the shaft 52.

While the front roller assembly 24 is fixed in position relative to the sewing head 50, the rear roller assembly 44 is adapted to be first translated laterally away from the sewing head 10 to accommodate various sizes of tubular bodies and then pivoted away from the sewing head 10 from a "home" position so as to apply additional tension to the elastic band 40 while applying tension to the fabric of the tubular body 42 prior to a sewing operation during which the elastic band 40 will be sewn on the tubular body 42.

Figure 2A:
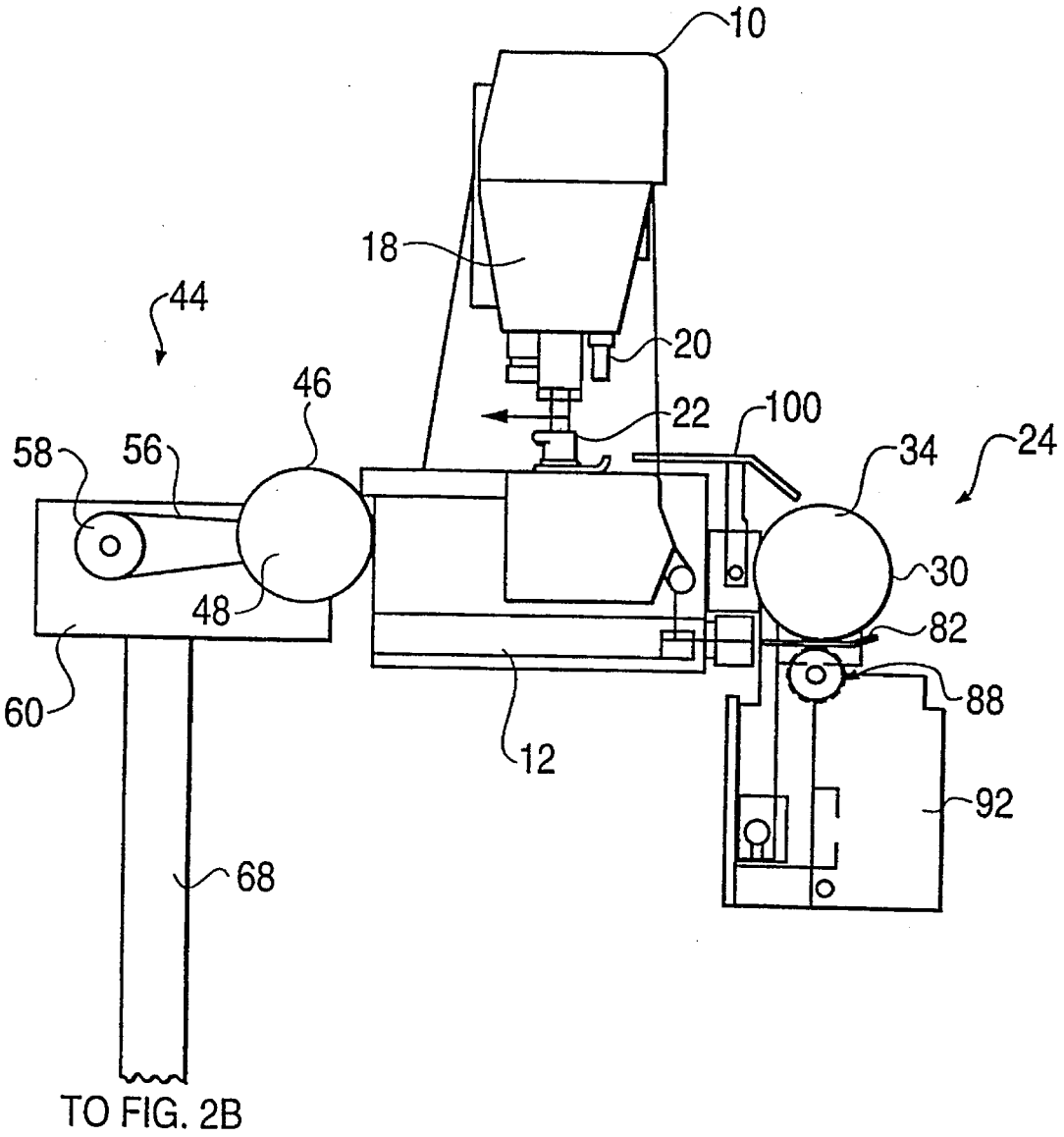
FIGS. 2A and 2B are a front elevational view of the embodiment shown in FIG. 1.
Figure 2B:
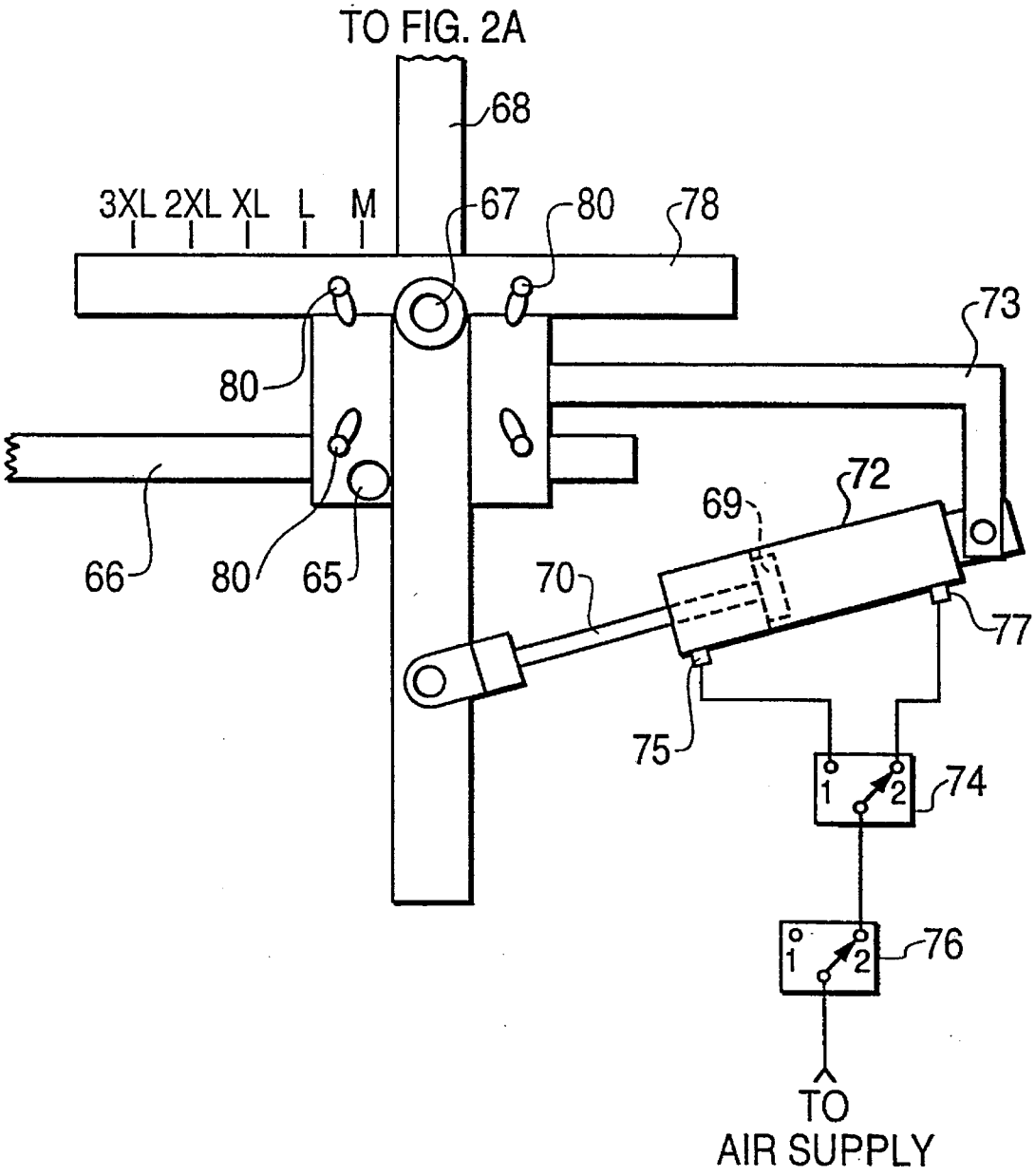

The structure for translating and rotating the rear roller assembly 44 relative to the sewing head 10 and the front roller assembly 30 comprises a pair of clamping plates 62 and 64 mounted on a fixed horizontal bar member 66. An elongated tension arm member 68 is pivotally mounted at 67 between the clamping plates 62 and 64 so that it can move toward and away from the sewing head 10. The upper end of the tension arm 68 is attached to the motor assembly plate 60, the other end is connected to the piston 69 and piston rod 70 of an air cylinder 72 shown in FIG. 2B which is actuated from a controlled pneumatic source, not shown, by a pair of remotely controlled pneumatic valves 74 and 76 and a pair of pneumatic ports 75 and 77 located at opposite ends of the cylinder 72. The upper end of the air cylinder 72 is connected to an angulated bar member 73 attached, for example, to the rear clamping plate 64. As shown in FIGS. 2A and 2B, the vertical position of the tension arm 68 corresponds to the home position of the rear drive and tensioning roller 46.

The sequence of operation for applying tension to the tubular body 42 prior to a sewing operation is as follows. The tubular body 42 is loaded onto the machine by being placed over front and rear roller members 30 and 46 where a photosensor, for example the photosensor 110 shown in FIG. 1 and which will be referred to subsequently, senses the presence of the tubular body 42. This sensing operation is used to activate valve 74 through a controller, not shown, which switches to position 1. Assuming that valve 74 is in position 2, air will be supplied to port 75 at the left side of the cylinder 72, causing the piston 69 to move to the right. The tension arm 68 now pivots in a counter clockwise (CCW) direction, thereby tensioning the tubular body 42. The pivoting operation takes place for a predetermined time as set by an operator for the size of the tubular body 42 being sewn. After the predetermined time has elapsed, valve 76 is caused to switch to position 1 which traps the air in the left side of the cylinder 72, thus preventing further motion and holding the piston 69 in a relatively fixed position. After the sewing operation is completed, valves 74 and 75 are switched to their position 2. This connects the air supply to port 77 which now drives the piston 69 and, accordingly, the tension arm 68 back to the vertical or home position where it abuts a stop shown by reference numeral 65 in FIG. 2B. The pneumatic source used to activate the air cylinder 72, moreover, is microprocessor controlled so that a synchronized operation of the entire circular sewing machine system is provided.

Also shown is a calibrated scale 78 which is horizontally mounted behind the tension arm 68 for prepositioning the entire assembly which is accomplished, for example, by an operator loosening a set of wing nuts 80 and sliding the assembly forward towards the sewing head 10 for a "small" size tubular body and away from the sewing head 10 for a "large" size tubular body, after which time the wing nuts 80 are again tightened, thereby establishing an initial "home" position of the tension bar 68 which can thereafter be rotated by actuation of the air cylinder 72.

Returning now to the right side of the sewing head 10, in addition to the front roller assembly 24 previously described, associated therewith is a separator plate assembly 80 including a generally flat plate 82 having a beveled leading edge 84, a piston type air cylinder 86, and a piston rod 87 which is also microprocessed controlled. The separator plate 82 is insertable between the elastic band 40 and the tubular body of fabric 42 during a sewing operation.

To the outside of the separator plate 82 is located an edge guide device 88 which forms part of an assembly 90 including a pivoted support member 92 which is coupled to an air cylinder 94, also microprocessor controlled, so that the edge guide 88 can be pivoted toward and away from the front roller assembly 30 and the separator plate 82. The edge guide 88, moreover, is journaled through the top portion of the member 92 where it is coupled to a drive motor 96. The edge guide device 88 additionally includes a plurality of transversely driven belts 98 which operate to move the leading edge portion of the fabric of the tubular body 42 relative to the elastic band 40 in a manner to be described when pressed against the separator plate 82. The details of the edge guide 88 are further disclosed in the above cross referenced related application of Johannes Sahl, Ser. No.

08/371,032, entitled, "Apparatus For Feeding A Workpiece In A Machine Tool", incorporated herein by reference.

On the inward side of the front roller assembly 30 toward the sewing head 10 is located a folder plate member 100 which includes a leading edge 102 which is angulated relative to the rotational axis of the front roller assembly 30 by an angle of approximately 45°. Mounted above the folding plate 100 is a set of air jet tubes 104, 106 and 108 which operate in conjunction with inner flange 38 of the inner section 32 of the split roller assembly 24 and the folder plate 100 to fold the fabric of the tubular body 42 around the elastic band 40 prior to their reaching the sewing head 10 in a manner to be described.

The sewing apparatus of the subject invention additionally includes two photo detector assemblies 110 and 112 which are located beneath the front roller assembly 30. The detector assemblies are directed upward so as to respectively detect the leading or unfolded edge 43 (FIG. 5) of the tubular body 42 and for detecting the leading edge of the seam, not shown, produced in the sewing operation, during which the elastic band 40 is attached to the tubular body 42 and terminating the sewing operation from a predetermined seam overlay during which a stitch counting operation takes place.

Following the foregoing description of the various components utilized in the invention, a complete sequence of operation will now be described.

Assume that the apparatus is initially at rest, i.e. the presser foot 22 is up, the needle 20 is positioned up and the rear tension roller 46 has been manually preset laterally to a fixed distance away from the front roller assembly 24 in its home or vertical position. The elastic band 40 is now stretched over the tapered outer section 30 of front roller assembly 24 and the tubular roller 46 of the drive and tensioning roller assembly 44 so that it resides in the flanged spool portion of the inner section 32 and the groove 50 of the rear roller 46. The elastic band 40 can now spin freely and independently of the outer section 30 of the front roller assembly 24. The tubular body of fabric 42 is next placed over the front roller assembly 24 such that it extends over the elastic band 40 and onto the sewing plate 10 until it hits a forwardly sloping stop plate 15.

The rear drive and tensioning roller assembly 44 now pivots away from the sewing head 10 and, in doing so, generates a desired amount of tension in the fabric of the tubular body 42 as described above. The separator plate is moved forward under the flanged spool member 32 of the front roller assembly in the area of the elastic band 40 so as to act as a barrier between the elastic band 40 and the tubular body 42 while allowing the material of the elastic body 42 to be moved freely in relationship to the elastic band 40. The separator plate also acts as a surface that the edge guide device 88 can work against. The edge guide device 88 is long enough to cover sufficient material to prevent the material from buckling and rotates in the direction of the material movement along with the rear roller member 46. The transverse belts 98 of the edge guide device 88 now operate to position the fabric of the tubular body 42 to and from the sewing head 10 where its position is sensed via the photo sensor 110, for example, mounted below the front roller assembly 24.

The sewing operation begins with the motor 54 being energized. This drives the rear roller 46 which begins to rotate, pulling the tubular body 42 toward the sewing head 10 along with the elastic band 40. In the process, after a programmed number of revolutions of the rear roller 46 based on the size of the tubular body 42, the material of the tubular body 42 begins to be folded around the elastic band 40 by the air jet tubes 104, 106, 108, the split roller assembly 24 and the fabric folding plate 100 in preparation of sewing. During the folding operation, an initial 90° downward fold of the material of the tubular body 42, as it moves toward the sewing head 10, occurs at the rear flange 38 of the inner section of the front roller assembly 24 by air jets from the tubes 104, 106 and 108 which blow down and away from the rear of the assembly toward the fabric. A second 90° fold is thereafter made by the leading edge 102 of the sloped plate 100 which folds the fabric tightly around the elastic band 40 prior to its reaching the presser foot 16 and needle 20.

This action in conjunction with the edge guide device 88 with its transversely mounted belts 98, together with the split front roller assembly 24 including the independently free wheeling front section 30 and the inner flanged section 32, allow the seam that has been sewn to overlap at a point where the stitching begins and end with the stitching overlap being also provided by a stitch count following the detection of the leading edge of the seam being sewn. This detection is made by way of the photodetector assembly 112 located below the front roller assembly 24.

Following the sewing of the elastic band 40 to the tubular fabric body 42 and following the termination of the seam overlap, the drive and tensioning roller 46 is again rotated back in a clockwise direction to its home position by the air cylinder 72. The tension in the fabric of the tubular body is released, thereby providing a garment with elasticized pleats uniformly located around an open end thereof.

The sewing operation completed, the garment is removed from the roller assemblies 24 and 44, either manually or by means of an automated stacker assembly, not shown, which moves to and from the sewing apparatus in timed relationship with the sewing operation.

Figure 4:
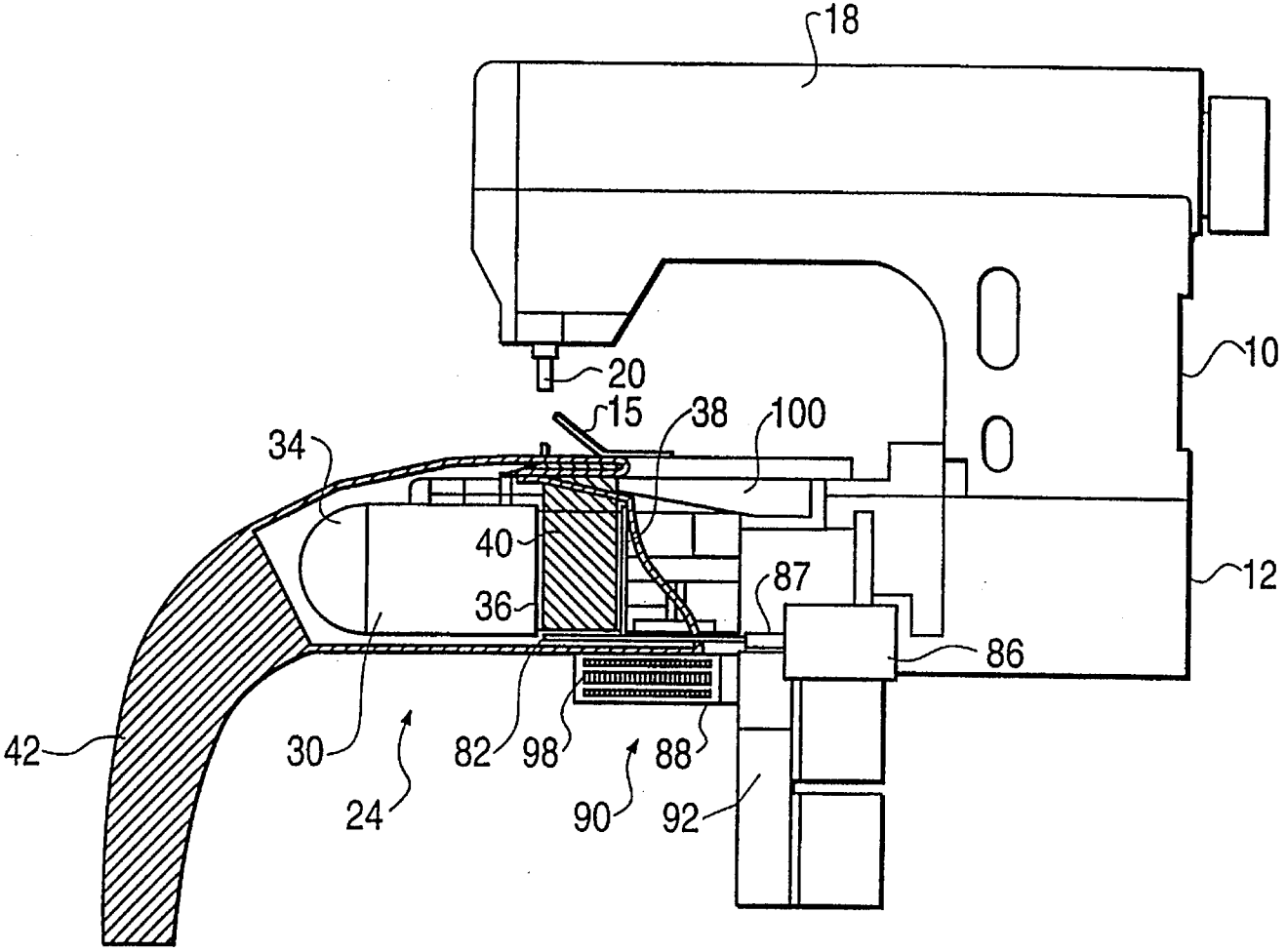
FIG. 4 is a side elevational view of the embodiment shown in FIG. 1 and additionally depicting a tubular body of fabric positioned over the elastic band shown in FIG. 3.

While the foregoing has dealt with the apparatus and operation of an improved circular sewing machine for sewing an elastic band on a tubular body of fabric, the same apparatus is also adapted to be used simply for sewing a hem on a tubular body of fabric, for example, the workpiece 42 shown in FIG. 4, without the elastic band. In this instance, the front roller assembly 24 is modified as shown in FIG. 5 to replace the split roller elements 30 and 32 by a unitary solid roller member 30' which is similar to the solid rear feed and tensioning roller 46 in that it includes a flat surface portion 33 which provides the surface against which the edge guide 88 can work against to position the fabric, not shown, via the transverse belts 98 as before. The forward portion 35 is also preferably tapered in the same manner as the roller member 30; however, when desirable, the forward portion 35 can be made identical to the tubular shape of the rear drive and tensioning roller 46. Also, not shown, the rear drive and tensioning roller 46 can be modified to eliminate the groove 50. In all other respects, the apparatus is same and the operation for sewing the hem is the same as described above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. Circular sewing machine apparatus, comprising:

a sewing head for attaching an elastic band to a tubular fabric body;

a stationary feed roller assembly including an elongated outwardly extending roller assembly for supporting both said elastic band and said tubular fabric body and being located on one side of the sewing head for bringing the elastic band and the tubular fabric body together prior to a band attaching operation at the sewing head;

a movable drive and tensioning roller assembly located on the other side of the sewing head for moving the elastic band and the tubular fabric body past the sewing head; and wherein said drive and tensioning roller assembly includes, an elongated outwardly extending motor driven roller for supporting both said elastic band and said tubular fabric body, first means for pre-positioning said drive and tensioning roller assembly to a fixed position relative to said sewing head and said feed roller assembly depending on the size of said tubular fabric body, prior to an elastic band and tubular fabric body loading operation, and second means for tensioning by active pneumatic control both the elastic band and the tubular fabric body prior to said band attaching operation by movement of said drive and tensioning roller assembly away from a home position at said fixed position and thereafter returning to said home position under active pneumatic control following said attachment operation and prior to an unloading operation.

2. Circular sewing machine apparatus according to claim 1 wherein said motor driven roller includes a generally rounded outer nose portion and a cylindrical inner portion for supporting the elastic band thereon.

3. Circular sewing machine apparatus according to claim 2 wherein the cylindrical inner portion of said motor driven roller includes an annular groove for retaining the elastic band.

4. Circular sewing machine apparatus according to claim 3 wherein said feed roller assembly also includes means for retaining the elastic band.

5. Circular sewing machine apparatus according to claim 1 wherein said drive and tensioning roller assembly includes motor means for driving said motor driven roller.

6. Circular sewing machine apparatus according to claim 5 and additionally including means for supporting both said motor means and said motor driven roller.

7. Circular sewing machine apparatus according to claim 6 and including means for coupling the motor means to the motor driven roller.

8. Circular sewing machine apparatus according to claim 6 wherein said means for coupling comprises belt and pulley means located on said means for supporting.

9. Circular sewing machine apparatus according to claim 1 wherein said first means for pre-positioning said drive and tensioning roller assembly includes a stationary elongated support member, a movable clamp assembly mounted on said support member, an elongated tensioning arm member pivotally attached to said clamp assembly, said tensioning arm member having one end coupled to said motor driven roller and the other end to a pneumatic activating air cylinder assembly.

10. Circular sewing machine apparatus according to claim 9 wherein said clamp assembly includes a stop for said tensioning arm member at said home position.

11. Circular sewing machine apparatus according to claim 9 wherein said pneumatic activating air cylinder assembly includes an air cylinder comprising a cylinder body and bidirectionally driven piston located therein and wherein one of said cylinder body and said piston is coupled to said tensioning arm member and the other of said cylinder body and said piston is coupled to said clamp assembly.

12. Circular sewing machine apparatus according to claim 11 and additionally including first and second stop valve means respectively coupled to opposite sides of said piston for supplying air to either side of said piston for actively driving said tensioning arm away from said home position so as to perform a fabric tensioning operation and returning back to said home position following said attachment operation.

13. Circular sewing machine apparatus according to claim 9 and additionally including a member located behind the tensioning arm member for providing an indication of the size of the tubular fabric body for pre-positioning said drive and tensioning roller assembly.

14. Circular sewing machine apparatus according to claim 13 wherein said member for providing an indication of size comprises a tubular body size scale.

15. Circular sewing machine apparatus, comprising:

a sewing head for sewing a hem on a tubular fabric body;

a stationary feed roller assembly located on one side of the sewing head and including an elongated outwardly extending roller assembly for supporting said tubular fabric body prior to a hem sewing operation at the sewing head;

a movable drive and tensioning roller assembly located on the other side of the sewing head for moving the tubular fabric body past the sewing head; and wherein said drive and tensioning roller assembly includes, an elongated outwardly extending motor driven roller for supporting said tubular fabric body, first means for pre-positioning said drive and tensioning roller assembly to a fixed position relative to said sewing head and said feed roller assembly depending on the size of said tubular fabric body, and second means for tensioning by active pneumatic control the tubular fabric body prior to a hemming operation by movement away from a home position at said fixed position and thereafter returning to said home position under active pneumatic control following said hemming operation and prior to an unloading operation.

16. Circular sewing machine apparatus according to claim 15 wherein said motor driven roller includes a generally rounded outer nose portion and a cylindrical inner portion for supporting the elastic band thereon.

17. Circular sewing machine apparatus according to claim 15 wherein said first means for pre-positioning said drive and tensioning roller assembly includes a stationary elongated support member, a movable clamp assembly mounted on said support member, an elongated tensioning arm member pivotally attached to said clamp assembly and having one end coupled to said motor driven roller and the other end to a pneumatically activated air cylinder assembly.

18. Circular sewing machine apparatus according to claim 17 wherein said clamp assembly includes a stop for said tensioning arm member at said home position.

19. Circular sewing machine apparatus according to claim 17 wherein said pneumatic activating air cylinder assembly includes an air cylinder comprising a cylinder body and bidirectionally driven piston located therein and wherein one of said cylinder body and said piston is coupled to said tensioning arm member and the other of said cylinder body and said piston is coupled to said clamp assembly.

20. Circular sewing machine apparatus according to claim 19 and additionally including first and second stop valve means respectively coupled to opposite sides of said piston for supplying air to either side of said piston for actively driving said tensioning arm away from said home position so as to perform a fabric tensioning operation and returning back to said home position following said hemming operation.

* * * * *